United States Patent [19]

Urso

[11] Patent Number: 4,650,448

[45] Date of Patent: Mar. 17, 1987

[54] MACHINE FOR FORMING FULL OVERLAP SHIPPING CONTAINER

[75] Inventor: Patrick F. Urso, Fife, Wash.

[73] Assignee: Weyerhaeuser Company, Tacoma, Wash.

[21] Appl. No.: 791,630

[22] Filed: Oct. 25, 1985

[51] Int. Cl.[4] ..... B31B 7/02

[52] U.S. Cl. ..... 493/18; 493/89; 493/110; 493/142

[58] Field of Search ..... 493/18, 29, 84, 89, 493/96, 110, 131, 132, 142, 151, 276, 295, 297, 906

[56] References Cited

U.S. PATENT DOCUMENTS

| | | | |
|---|---|---|---|
| 1,265,273 | 5/1918 | Stokes et al. | 493/84 |
| 2,016,462 | 10/1935 | Stokes | 493/115 |
| 2,018,237 | 10/1935 | Stokes | 493/110 |
| 2,111,157 | 3/1938 | Stokes | 493/110 |
| 2,144,764 | 1/1939 | Lange et al. | 493/110 |
| 3,392,637 | 7/1968 | Back | 493/96 |
| 3,986,441 | 10/1976 | Jaton | 493/96 |
| 4,368,052 | 1/1983 | Bitsky et al. | 493/96 |
| 4,563,169 | 1/1986 | Virta et al. | 493/96 |

FOREIGN PATENT DOCUMENTS

| | | | |
|---|---|---|---|
| 608938 | 9/1948 | United Kingdom | 493/110 |

*Primary Examiner*—Lowell A. Larson
*Assistant Examiner*—William E. Terrell

[57] ABSTRACT

The invention is a mahcine for forming a full overlap-type shipping container from two similar blanks. A full overlap container normally has the end flaps of double thickness to withstand high top-to-bottom compression loads. This container has double thickness in both the end flaps and the laminated side walls. The machine is designated so that a first blank is transported on a main conveyor to a retractable stop located at a first combining section. Adhesive is applied to one of the side panels during transport. A second blank is then transported on a cross-conveyor to a second stop. This blank is lifted over the stop, and one side panel is positioned over the adhesive covered panel of the first blank. Pressure rolls then come into play to combine the panels. Assembly can now be completed on conventional equipment, such as folder-gluer, or may be done on an extended portion of the machine. In the latter case, the blanks are transported to a second combining station. During transport, adhesive is appropriately applied to a second side panel. A retractable stop holds the panel in place while folder arms complete the assembly. After folding, a second set of pressure rolls holds the newly bonded side panels in place until the adhesive has set.

22 Claims, 22 Drawing Figures

42
60
42
144
142
148
150
146
106
97
116
90
92
94
238
236
232
2
190
180
182
184
186
188
82
84
188
86
100
83
85
88
87
101

Fig. 17
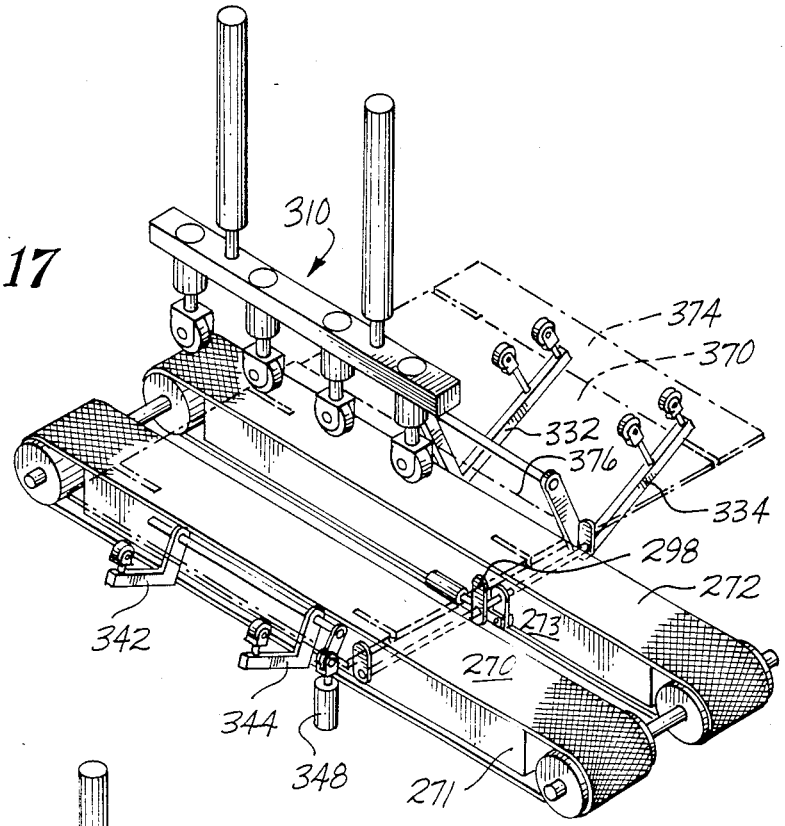
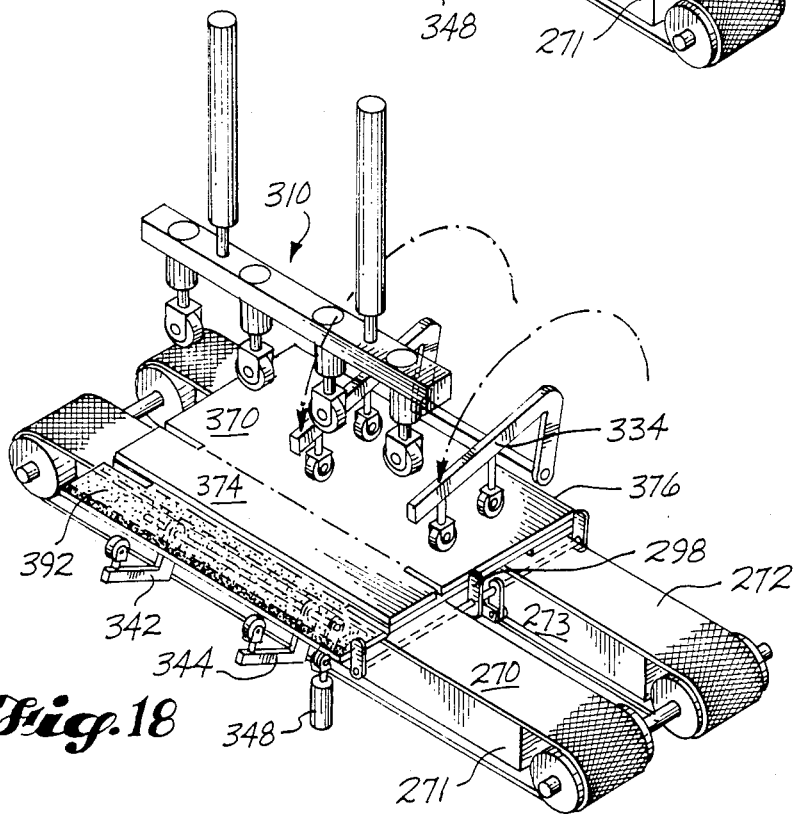
Fig. 18

MACHINE FOR FORMING FULL OVERLAP SHIPPING CONTAINER

BACKGROUND OF THE INVENTION

The present invention is directed to a machine for forming a full overlap shipping container. One embodiment of the machine forms an intermediate product by laminating single side panels of the two blanks. A second embodiment is useful for preparing a fully assembled container ready for erection and filling.

Full overlap shipping containers are those in which at least two of the side walls have double thicknesses of corrugated board. A container of this type is shown in U.S. Pat. No. 3,543,994 to Clark. Full overlap containers have superior stacking strength without the necessity for making complex and expensive interior inserts.

Full overlap containers have been found advantageous for shipping many products of commerce. Shelled nuts are one example. One application requires a container that can hold 50 lbs. of shelled almonds and be stacked five high on a pallet and five pallets high. In essence, this means that the lower-most container must support a load of almost 1,300 lbs. without crushing. A standard full overlap container requires a special insert for this application.

It is has been impractical to make a full overlap container with four sides having a double thickness from a single blank. Normally, two essentially identical blanks are used with the side panels being laminated. Unfortunately, these containers have not had wide usage because of the high expense involved in assembling them. Prior to the present invention, no machinery was in existence for gluing the two blanks together in an appropriate fashion and it was necessary to do this operation by hand. The present invention has overcome this problem. It can optionally prepare a flat blank, in which only one set of side panels are glued, or it can prepare a fully assembled container in which both sets of side panels are glued. In the former case, assembly can be completed on existing equipment such as a printer-slotter or a folder-gluer.

SUMMARY OF THE INVENTION

The present invention is a machine for forming a full overlap shipping container blank or a like article from two similarly configured planar container blanks. Each of the planar blanks will have at least a main panel flanked on either side by longitudinal side panels. Normally the blanks will also have appropriate end flaps which will be glued to form multi-ply end walls when the flat container is erected at the point of use. The machine comprises a frame which supports the component parts of the apparatus. Mounted on the frame is a main or a longitudinal conveyor configured to convey a first container blank to a combining station where it is joined to a second container blank brought in by a cross-conveyor situated normal to the main conveyor. The cross-conveyor is positioned in-line with the combining station. A retractable first stop is located adjacent to the first conveyor for temporarily positioning and holding the first container blank at the combining station until the second blank is joined to it. The first and second blanks are fed from individual stacks to the appropriate conveyors. A low, preferably permanent, stop is located at the proximal end of the cross-conveyor. An appropriate adhesive is applied to one side panel or flap of the first container blank as it travels along the main conveyor enroute to the combining station upstream from the first stop. When the first and second container blanks are in position against their respective stops, a lifting and indexing mechanism is provided to lift the second blank over its restraining stop so that one of its side panels is positioned over the adhesive covered side panel of the first blank. When appropriately positioned, the lifting and indexing mechanism lowers the second blank into contact with the adhesive covered panel. The blank is released and the lifting and indexing mechanism returns to its original position. Simultaneously, a pressure mechanism situated over the first combining station is lowered to press the registered side panels together to form a first glue line. At this time, the first stop adjacent to the main conveyor is removed and the once-bonded panels are free to be conveyed from the machine or to a second combining station. The invention includes drive mechanisms for the conveyors and appropriate control and timing mechanisms for controlling the sequence of operational steps.

In the case when the full overlap container is to be completely assembled, a further conveyor mechanism in line with the main conveyor is provided to transport the once-bonded blanks against a third stop located at a second combining and folding station. While in transit, a second adhesive applicator applies adhesive to the uncombined flap of either of the original blanks. When the blank arrives at the third stop, a first folding arm folds the main panel having the adhesive-free flap into a flat configuration overlying the other main panel. At this time a second folding arm is provided to fold the adhesive-coated flap into a flat configuration overlying the adhesive-free flap. A second pressure mechanism is then activated to combine the now-registered second flaps into a second glue line. When this is accomplished, the third stop is removed to allow the assembled container blanks to conveyed from the machine.

It is an object of the present invention to provide a machine for partially or fully assembling a full overlap shipping container.

It is another object to provide a machine for fully or partially assembling a full overlap shipping container at a high rate of speed.

It is another object to provide a machine which can automatically assemble a full overlap shipping container with four sides having a double thickness without the necessity of manual operations.

These and many other objects will become readily apparent to those skilled in the art upon reading the following detailed description taken in conjunction with the drawings.

BRIEF DESCRIPTION OF THE DRAWINGS

FIGS. 17 and 18 show the first step of folding the blanks.

DESCRIPTION OF THE PREFERRED EMBODIMENTS

In the description that follows, various zones are indicated on the drawings at which certain operations occur. These zones are shown in FIGS. 1A, 1B, 2A and 2B as follows:

A. Relates to the first container blank feed station and main conveyor.

B. Relates to the second container blank feed station and cross-conveyor.

C. Relates to the first assembly station.

D. Is concerned with the first compression section.

E. Relates to the folder section.

Figure 11:
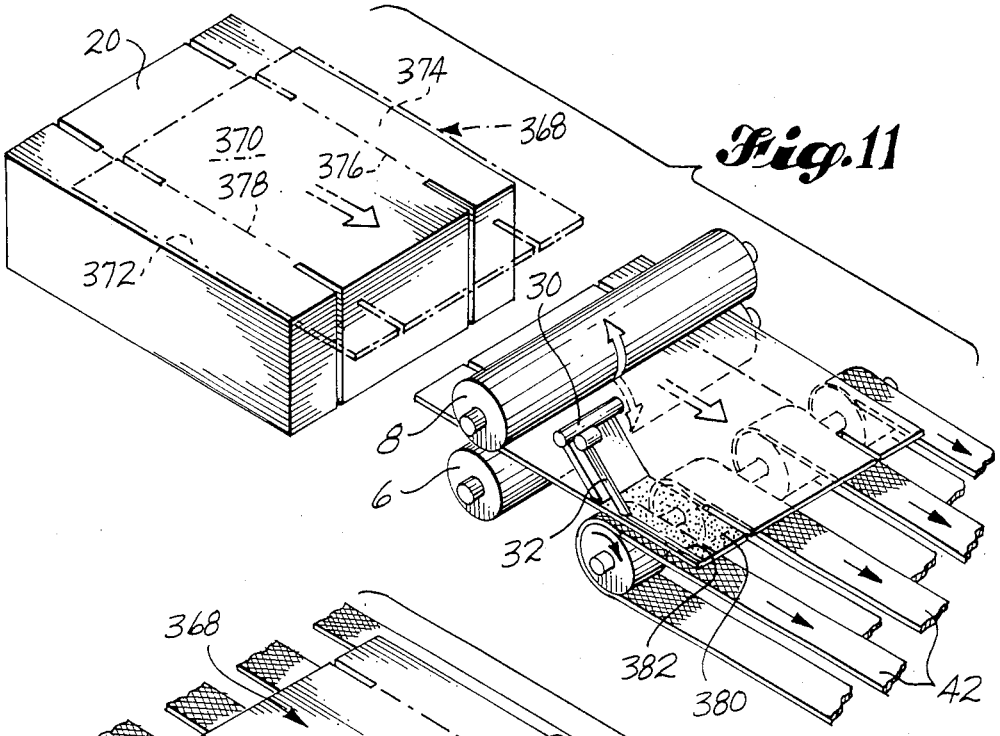
FIG. 11 shows a first blank passing through the feed rolls and the first adhesive applicator.

It might be helpful to the understanding of the machine itself in its various embodiments to look first at its mode of operation. To this end, FIGS. 11–20 should be consulted. FIG. 11 shows a stack of shipping container blanks 20, a pair of feed rolls 6, 8, an adhesive applicator 30, 32 and a main conveyor 42. An individual blank 368, shown in phantom form, consists of a main panel 370 with side flaps or panels 372, 374 defined by score lines 376, 378. As one of the blanks is passed through the feed rolls, a starch or other aqueous adhesive 380 is applied over essentially the full width of side panel 372 by applicator 30. Optionally, a narrow bead of a hot melt adhesive 382 may be placed on the edge of the panel by applicator 32.

Figure 12:
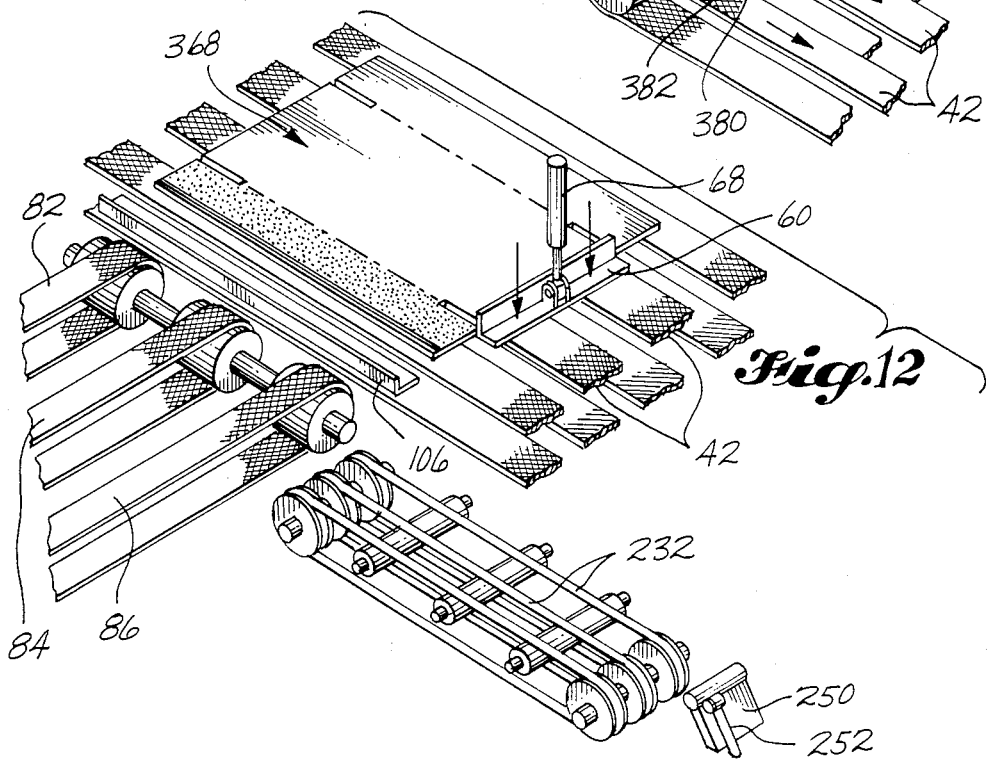
FIG. 12 shows the first blank in position for mating with the second blank.

As seen in FIG. 12, the blank 368, with adhesive applied to side panel 372, moves along the conveyor until it encounters retractable stop 60 which has been put into place by an actuator 68. Here a cross-conveyor having belts 82, 84, 86 is located normal to the main conveyor and opposite the position where blank 368 comes to rest against stop 60. A low permanently placed stop 106 is located at the proximal end of the cross-conveyor. The purpose of a third conveyor having belts 232 and a second adhesive applicator 250, 252 will be explained later.

Figure 13:
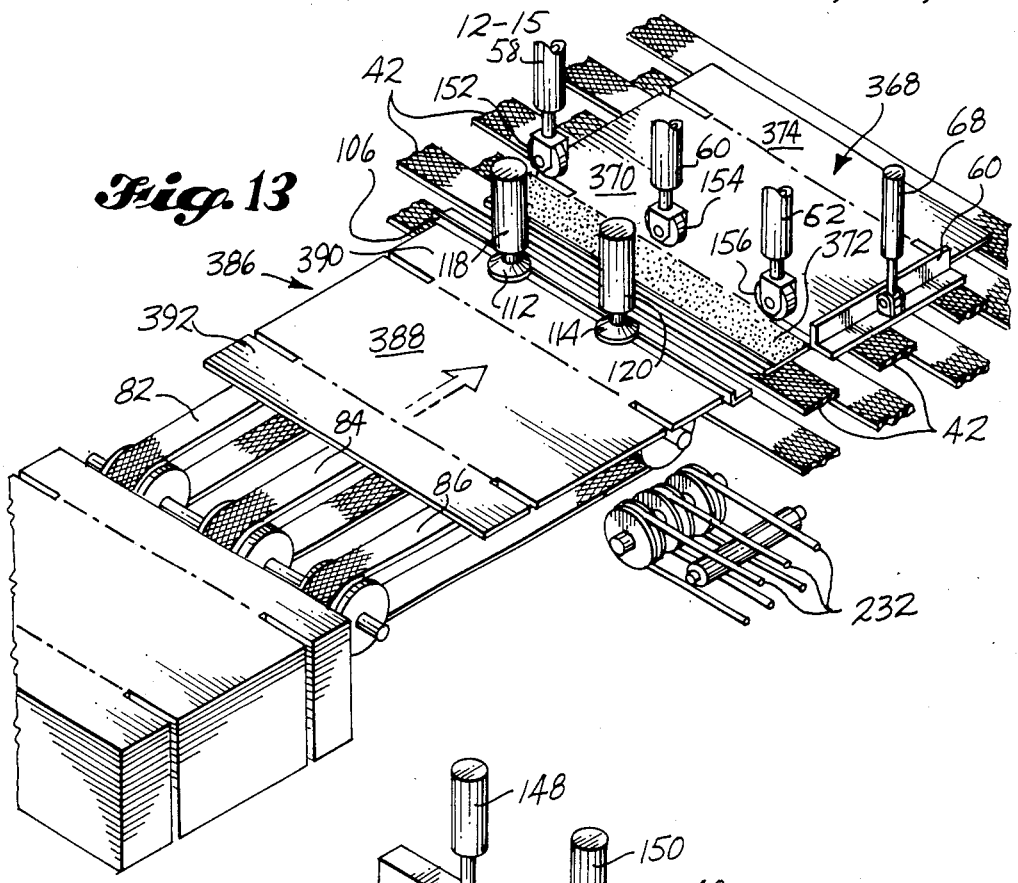
FIG. 13 shows the second blank on the cross-feed conveyor in position to be transferred to mating engagement with the first blank.
Figure 14:
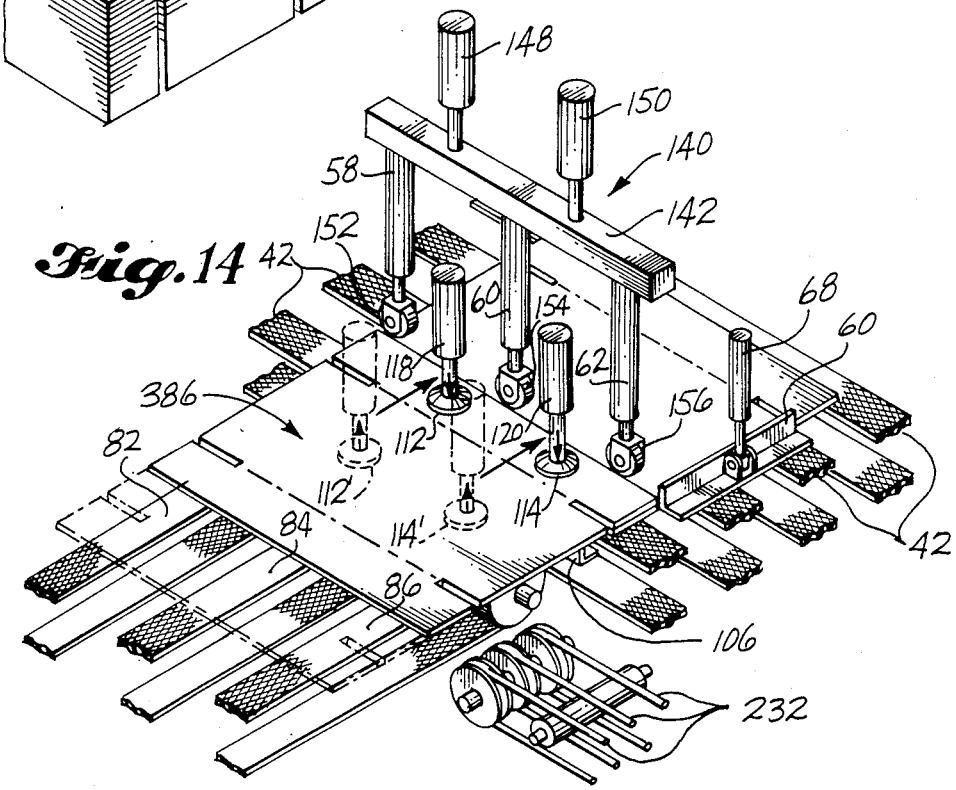
FIG. 14 is similar to FIG. 13 with one side panel of the two blanks being mated.

FIG. 13 shows a second container blank, similar in configuration to the first, located at the proximal end of the cross-conveyor and resting against stop 106. The second blank 386 has a main panel 388 and side panels or flaps 390, 392. As blank 386 reaches its respective stop, a sensor responds by shutting off the conveyor. However, an additional series of actions is triggered when the second blank 386 encounters stop 106. A transfer apparatus, shown in FIG. 13 as vacuum cups 112, 114, translates downward until the vacuum cups engage flap 390 of the second container blank. With the blank so engaged, the vacuum cups 112, 114 again move upward and then translate transversely over the main conveyor line so that flap or side panel 390 of the second blank is positioned over the adhesive coated flap 372 of the first blank. When so positioned, the vacuum cups again translate downward, release the container blank, and return to their original position. Simultaneously with the vacuum cups downward translation, the pressure rollers 152, 154, 156 attached to bar 142 are forced downward by actuating cylinders 148, 150 (FIG. 14). These bear against the assembled side panels in the area in which the hot melt adhesive was applied. By so doing, a fast bond is attained which holds the panels together until the slower setting starch or synthetic adhesive achieves good bonding strength.

As noted in FIG. 14, the trailing end of blank 386, notably panel 388 is resting on stop 106 which remains permanently in place.

Figure 15:
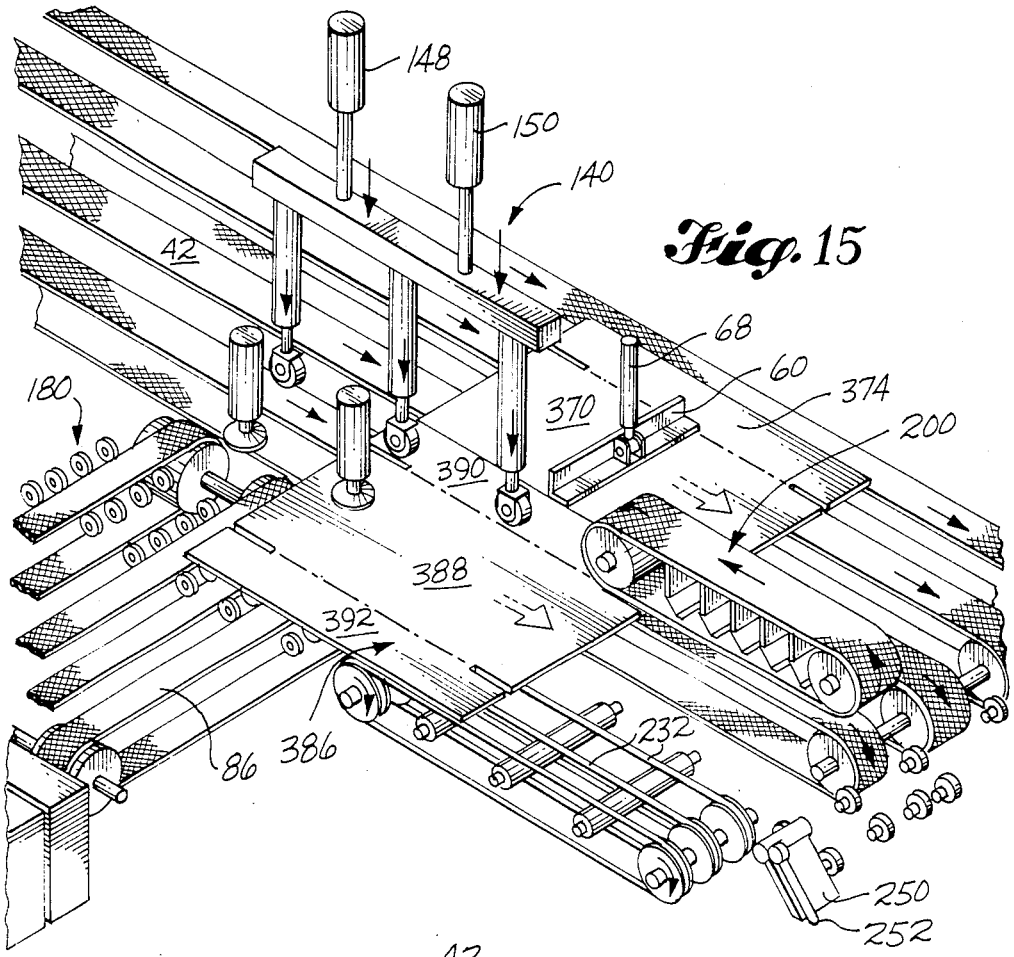
FIG. 15 shows the once-glued blanks moving through the compression section of FIG. 8.

Referring now to FIG. 15, when the pressure roll assembly 140 has descended against the container blanks, stop 60 is raised by actuating cylinder 68. At the same time, a swinging wheel case 180 is raised to lift the main panel 388 of the second blank above the level and cross-conveyor belts 86. At this time the main conveyor 42 is again actuated and the panels move along this conveyor under a belt 200 which applies pressure the full width of the glued area. Side conveyor 232 supports the outboard end of the second container blank 386.

In the most basic version of the apparatus the operations are completed at this point. It is now possible to finish assembly of the shipping container on a conventional folder-gluer or similar machine if desired. However, an alternative procedure which fully assembles the shipping container, ready for erection, will now be described.

Figure 16:
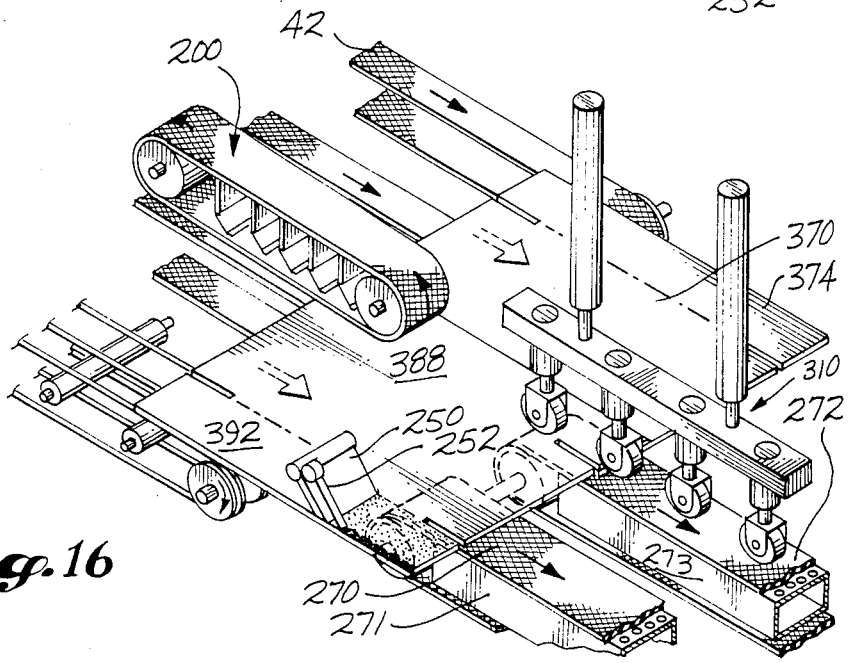
FIG. 16 shows adhesive being applied to one flap of the second blank.
Figure 19:
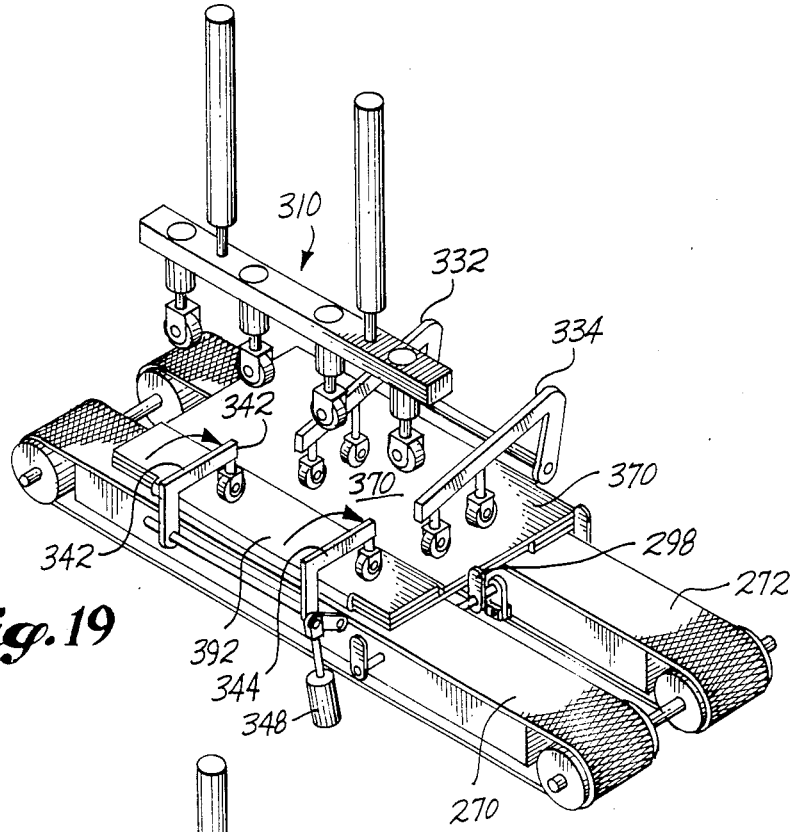
FIG. 19 shows the final step of folding the blanks.
Figure 20:
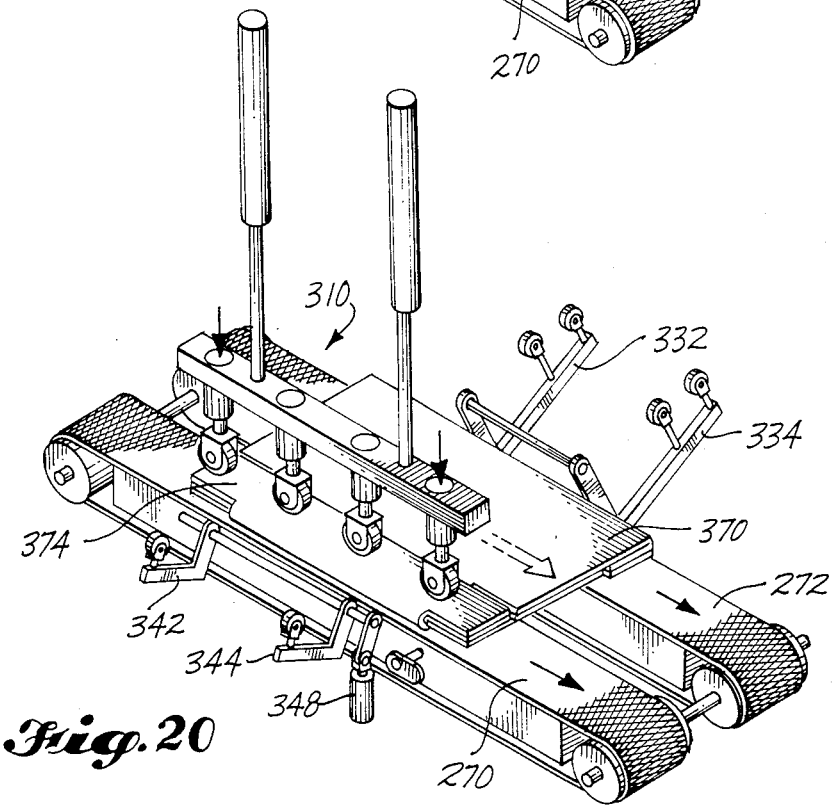
FIG. 20 shows the second pair of bonded side flaps running under the second compression rolls.

As seen in FIG. 16, the adhesive spreaders 250, 252 apply a band of adhesive to side panel 392 of the second container blank in much the same fashion as adhesive was applied to the first container blank. As the assembly leaves the main conveyor belts 42, it is picked up by vacuum belts 270, 272 running over vacuum boxes 271, 273. When in proper position, the assembly hits a third stop 298 which stops travel of the vacuum belts and actuates the folding mechanism. As seen best in FIGS. 17 and 18, folder arms 332, 334 bend over the first container blank along score line 376. These remain in place and immediately thereafter the second folder arms 342, 344 are actuated by cylinder 348. These arms fold the adhesive coated flap 392 of the second container blank over flap 374 of the first container blank (FIG. 19). As soon as the fold is completed, pressure assembly 310 then descends to provide a short-time holding force on the folded side panels. When the pressure assembly reaches the bottom of its travel, folder arms 332, 334, 342 and 344 retract to their original position. At the same time, stop 298 retracts and the vacuum belts 270, 272 are again started to run the now fully assembled container out of the machine and into a compression conveyor which is not a part of this invention.

Figure 1A:
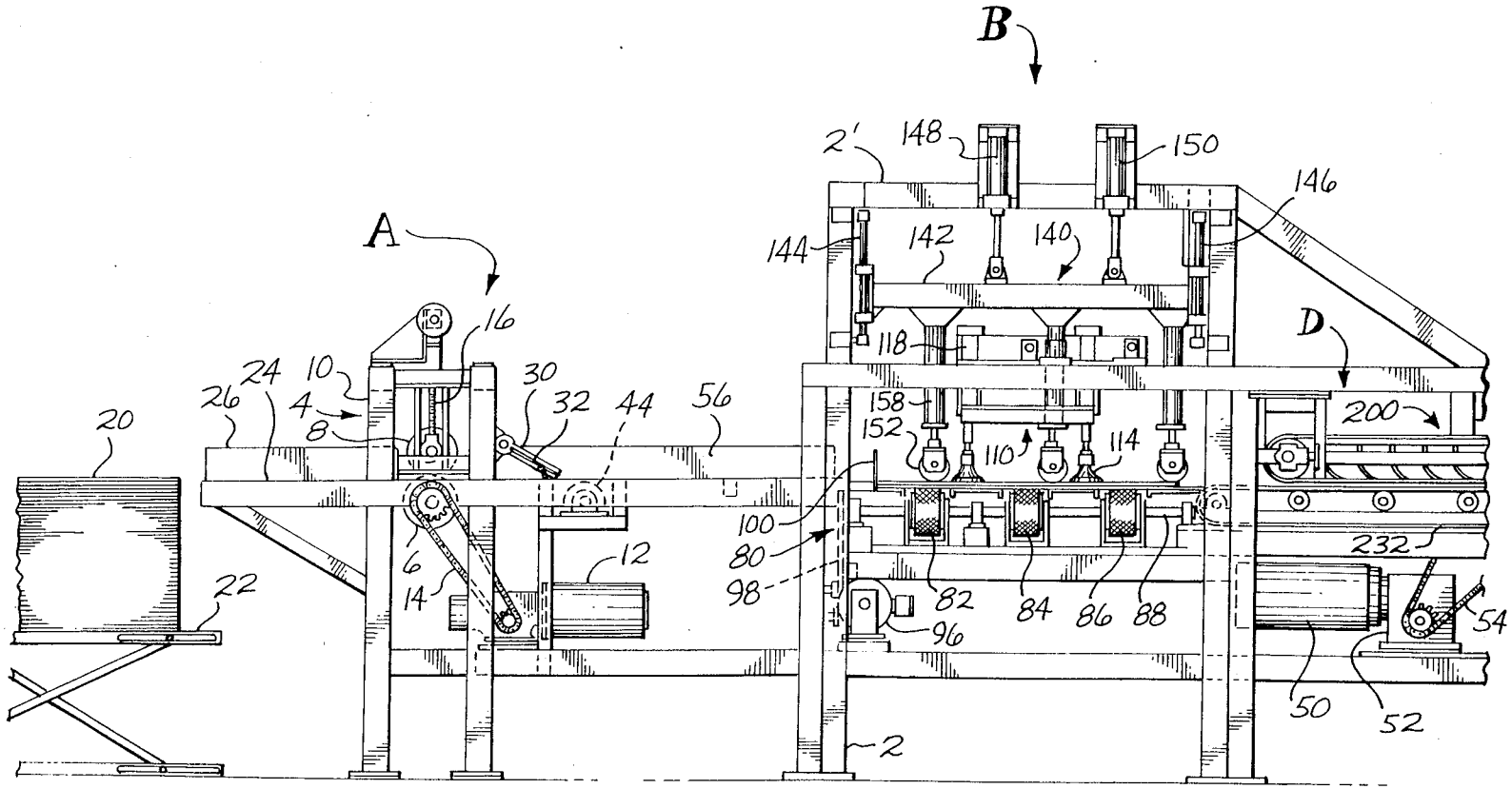
FIG. 1A is a right side elevation of the left portion of a complete container assembly machine.

Reference should now be made to FIGS. 1A–8 as the machine itself is described in detail. FIGS. 1A and 2A give an overall picture of the basic apparatus. The area indicated by A. shows the main conveyor feed section, that designated B. is the cross-conveyor and transfer mechanism, and C. represents the first combining station.

Figure 1B:
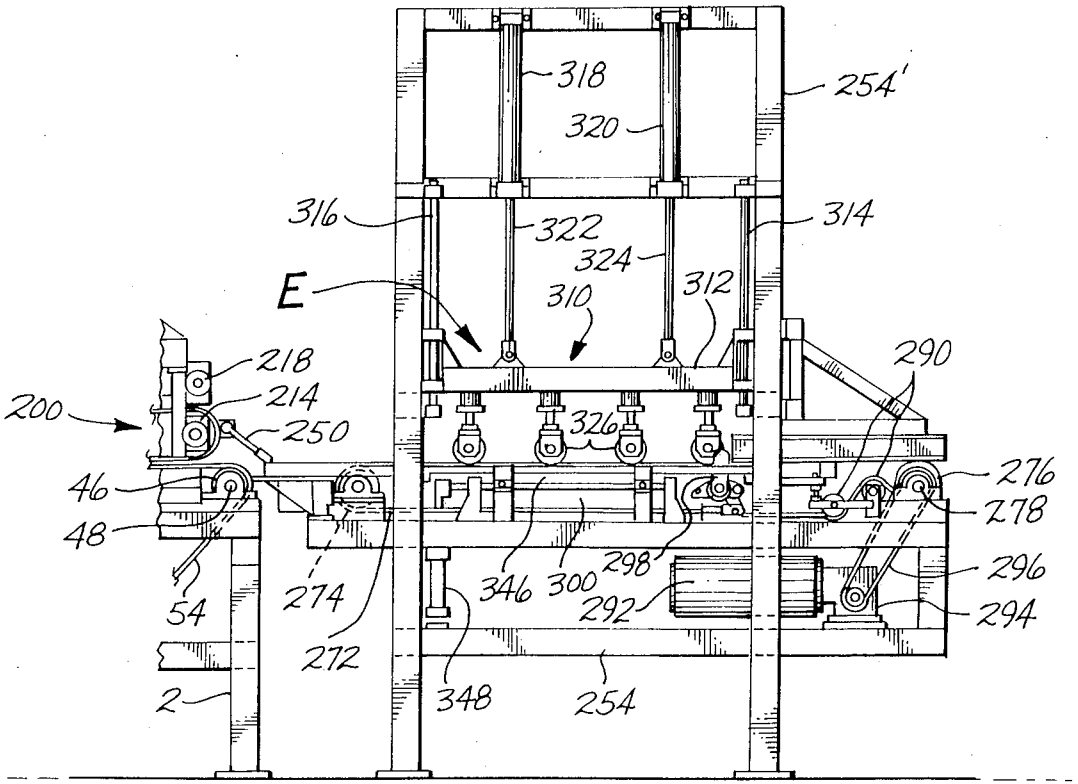
FIG. 1B is a similar elevation for the right portion of the machine.

For the sake of future reference, the "basic machine" will be that portion largely shown on FIGS. 1A and 1B that bonds a single pair of flaps to unitize the two separate shipping container blanks. The "expanded machine" includes that portion largely seen on FIGS. 1B and 2B which bonds the second set of side panels.

Figure 2A:
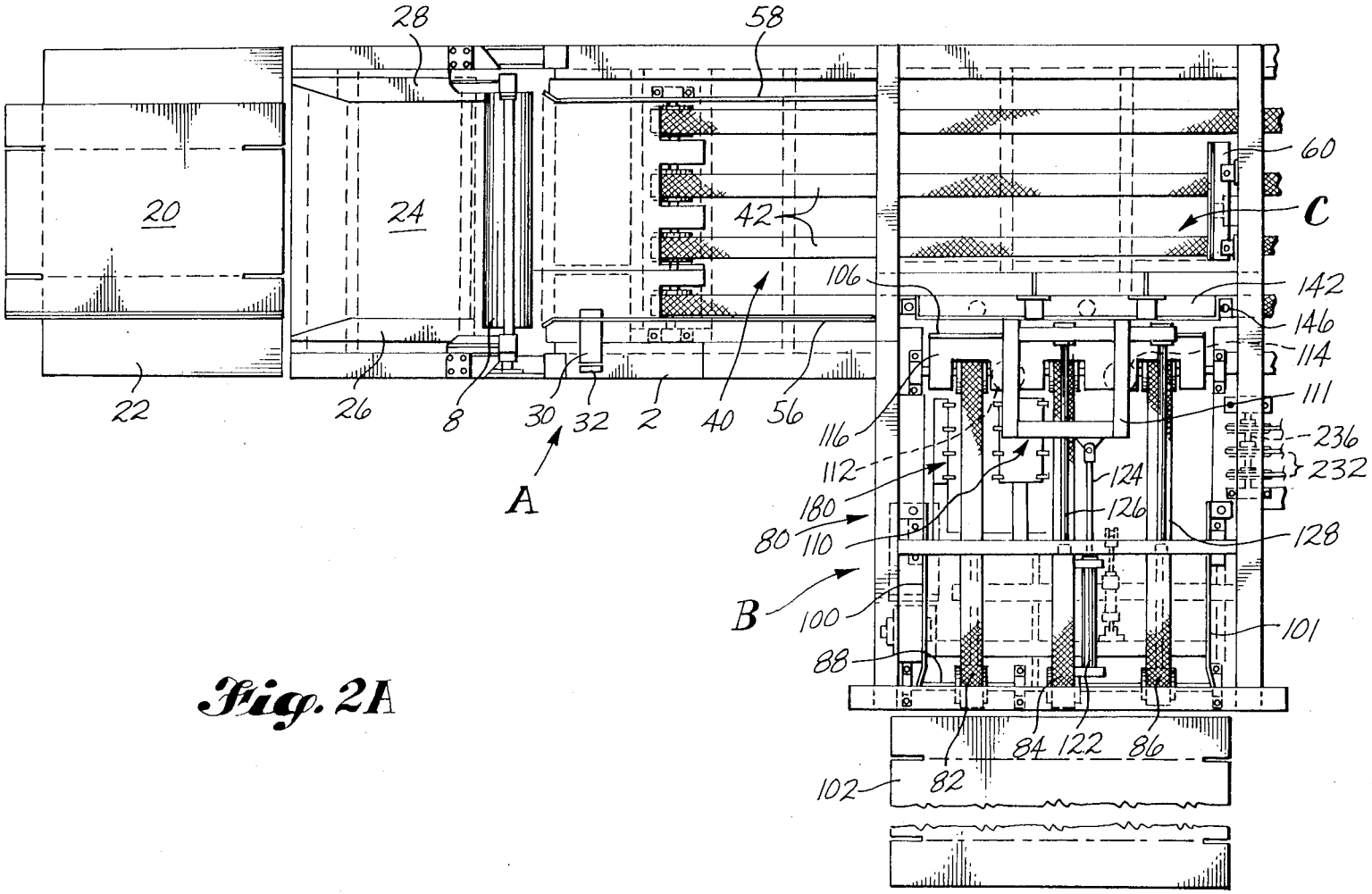
FIG. 2A is a top plan view of the left portion of the container assembly machine.

Referring now to FIGS. 1A and 2A, the basic machine is assembled on a frame 2. This frame supports a feed roll assembly, generally indicated at 4, having a driven roll 6 and an idling roll 8. A subframe 10 holds the idling roll and an adjusting system 16. A drive motor and a gear box 12 and drive chain or belt 14 complete the feed roll assembly. To the left of the machine, a stack of blanks 20 is placed on a scissors lift 22 from which blanks can be either hand fed or automatically fed onto the main conveyor. A feed table 24 receives the blanks which are guided into position to enter the feed rolls by fences 26, 28. As the blanks leave feed rolls 6, 8, an adhesive applicator mechanism 30, 32 applies adhesive the full width of one edge panel. As was described previously, this adhesive may be a starch or synthetic type laid down by the wider applicator 30 but it may also include a narrow bead of a quick-grabbing hot melt type as would be applied by applicator 32.

As the blanks leave the feed rolls, they are picked up by a main conveyor system generally shown at 40. This consists of a plurality of parallel belts 42, only two of which are numbered. These belts run on a set of idling rollers 44 at the infeed end and on driven rollers 46 at the outfeed end. The outfeed rollers are mounted on shaft 48 (FIG. 1B). This drive shaft is connected through drive chain 54 to a drive motor and clutch brake 50 through an intermediate gear box 52.

Movable fences 56, 58 serve to precisely position the first container blank as it moves down the main conveyor. Retractable stop 60 is now in place. When the container blank hits this stop, a sensor is encountered and motor/clutch brake 50 is deactivated, stopping conveyor 40. Operating details of stop 60 are best seen on FIG. 5. The stop itself is attached to a yoke 62 which translates vertically on ways 64, 66 and is activated by a pneumatic cylinder 68 through piston rod 70.

Figure 3:
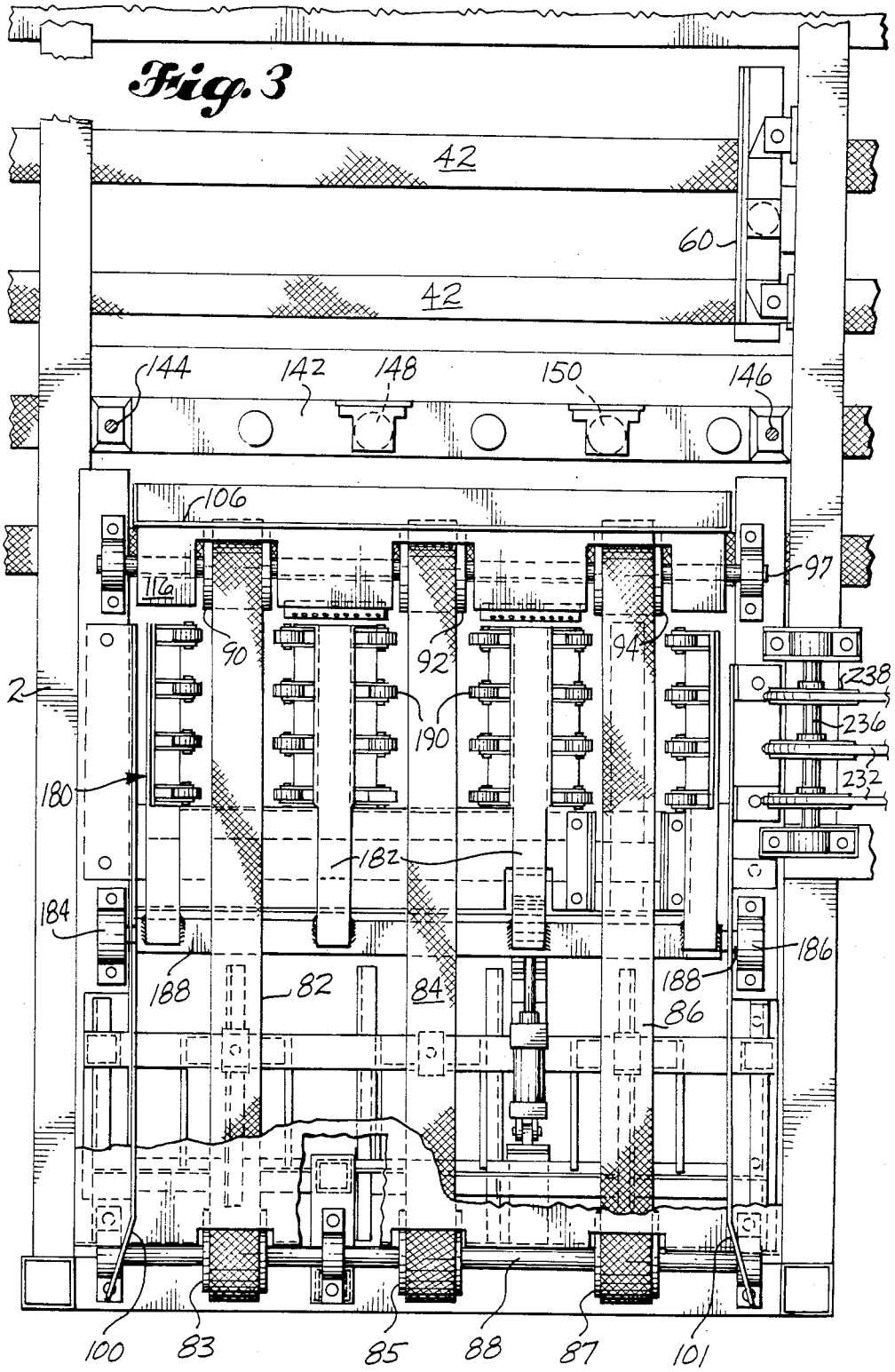
FIG. 3 is a top plan view in greater detail showing the cross-conveyor and first combining station seen in areas B and C of FIG. 2A.

At the time the first container blank is fed to the machine, or when it is positioned against stop 60, a second container blank may also be fed on the cross-feed mechanism generally indicated at 80 (FIG. 2A). As shown in FIG. 3, this comprises three moving belts 82, 84, 86 mounted at their distal or infeed end on driven pulleys 83, 85, 87 positioned on drive shaft 88. At the proximal or outfeed end, the belts ride on idling pulleys 90, 92, 94. These pulleys are mounted on idling shaft 97. The cross-feed belts run over a set of tensioning pulleys 95 (see FIG. 5). They are driven by a drive motor and gear box 96 by a belt or chain 98. Movable fences 100, 101 control the precise location of the second container blank fed by the cross-conveyor. These are taken from a stack of blanks 102 which also rest on a scissors lift, not shown. This blank will move down the cross feed conveyor until it hits the low fixed stop 106. At this point, another sensor is activated and the second conveyor is shut down. When both blanks are in place, a vacuum transfer mechanism 110, otherwise called a lifting and indexing mechanism, is activated. This mechanism is shown in FIGS. 1A and 2A, but is best seen on FIGS. 6 and 7.

Figure 5:
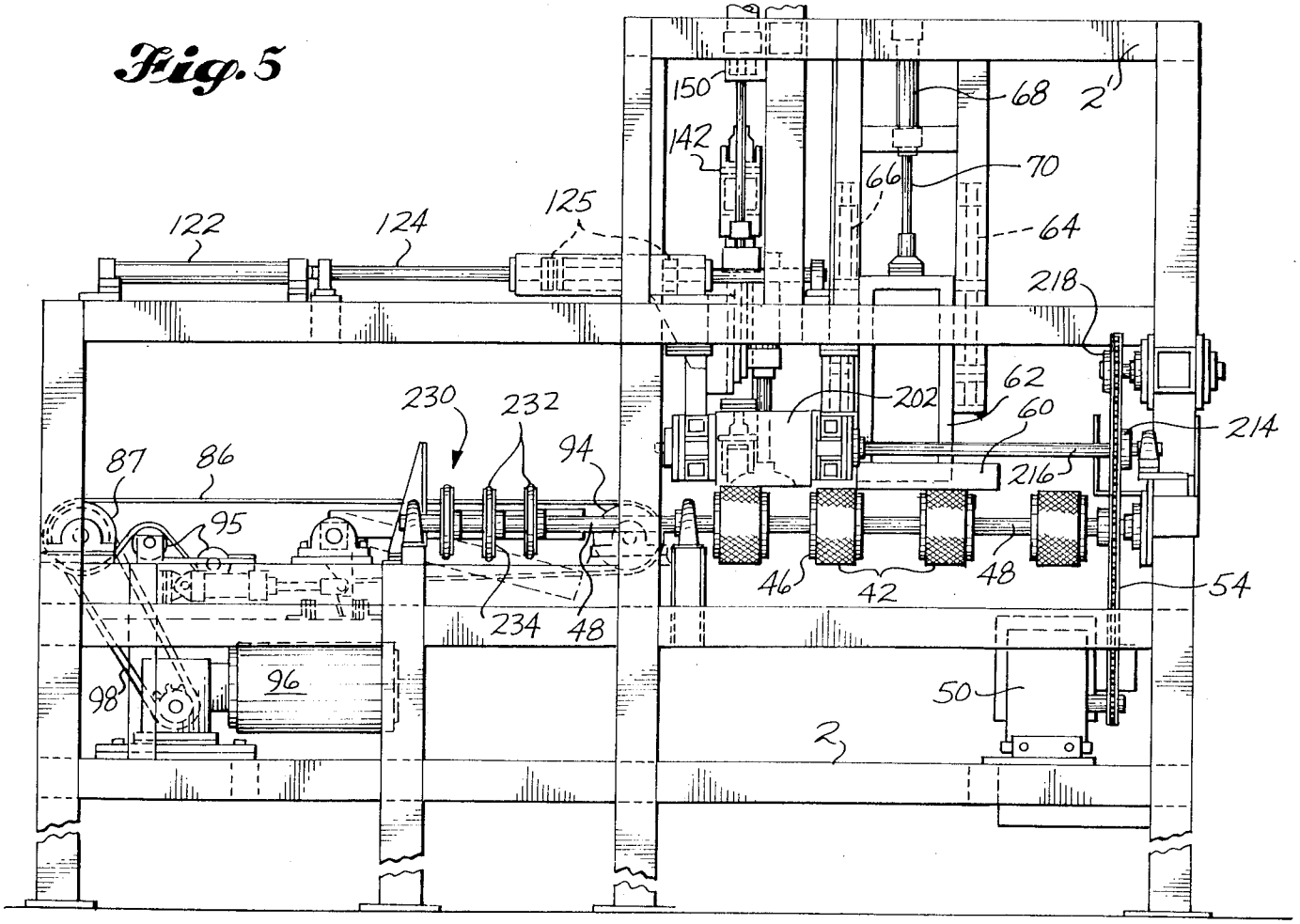
FIG. 5 is a side elevation generally taken looking toward the right-hand end of the portion of the machine pictured in FIG. 2A.
Figure 6:
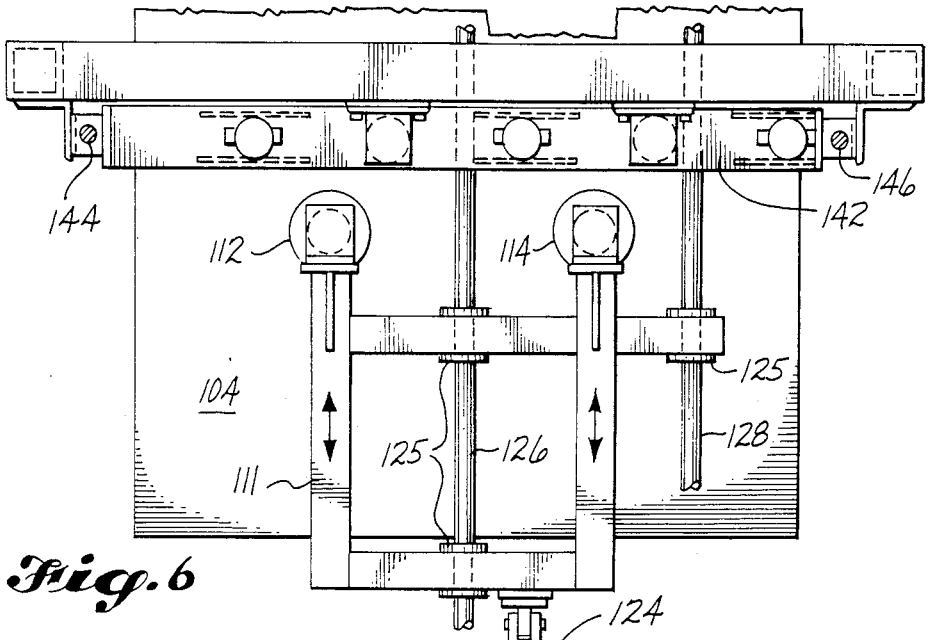
FIG. 6 is a more detailed top plan view of the transfer mechanism located in area B of FIG. 2A.

The vacuum transfer mechanism, generally shown at 110, consists of a subframe 111 and a pair of vacuum cups 112, 114. When the second container blank is in position against stop 106, one longitudinal panel will lie over a bearing plate 116. Vacuum cups 112, 114 are mounted at the lower end of a pair of pneumatic cylinders 118, 120. These, in turn, are mounted on a bar or subframe 111 which is activated by a transfer cylinder 122 and piston rod 124. Subframe 111 is mounted on ways or shafts 126, 128 by a set of bushings 125 (FIG. 5).

Figure 7:
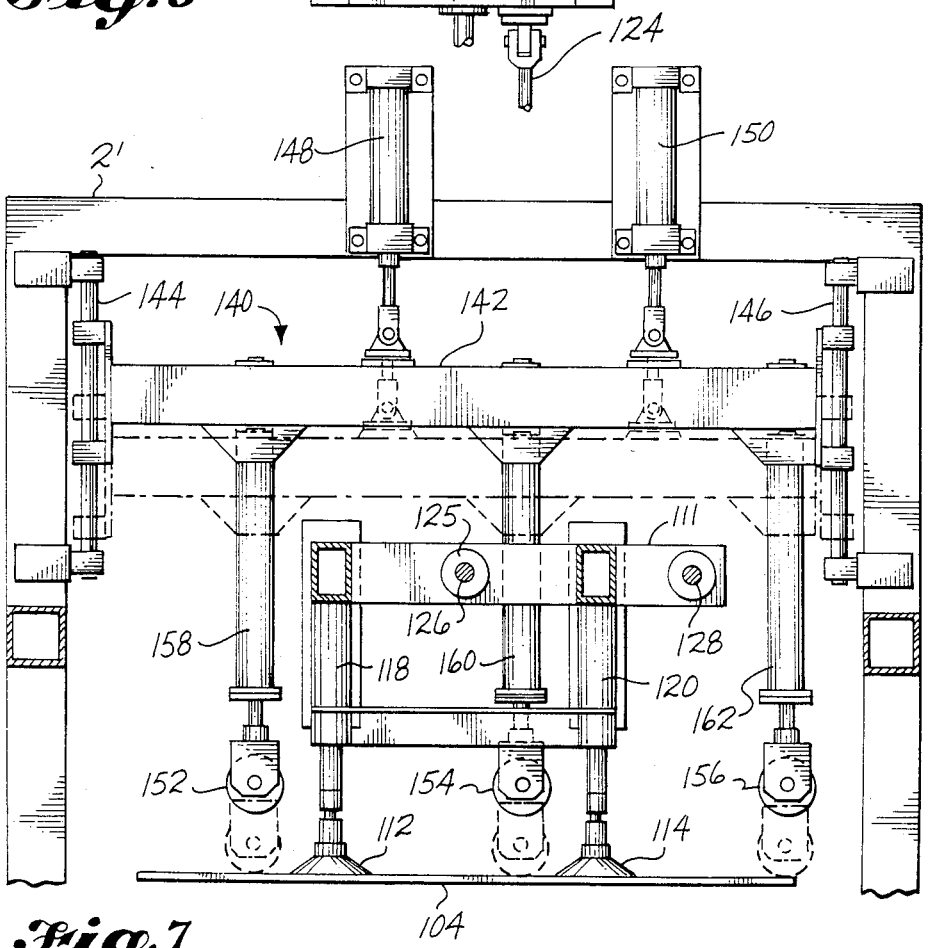
FIG. 7 is a more detailed side elevation of the superstructure showing the transfer and container blank mating mechanism as seen in area B of FIG. 1A.

After the second blank has been transferred over the first, as was explained previously, the transfer mechanism retracts after a pressure assembly generally shown at 140 is brought into play. This is best seen in FIGS. 1A and 7. The pressure mechanism has a subframe 142 which is mounted to the main frame on ways 144, 146. The subframe is activated by pneumatic cylinders 148, 150 which are located on an extension of the main frame 2'. Pressure wheels 152, 154, 156 depend from subframe 142 and are located at the lower end of spring cartridges 158, 160, 162. These provide a degree of resiliency to the pressure wheels.

Figure 4:
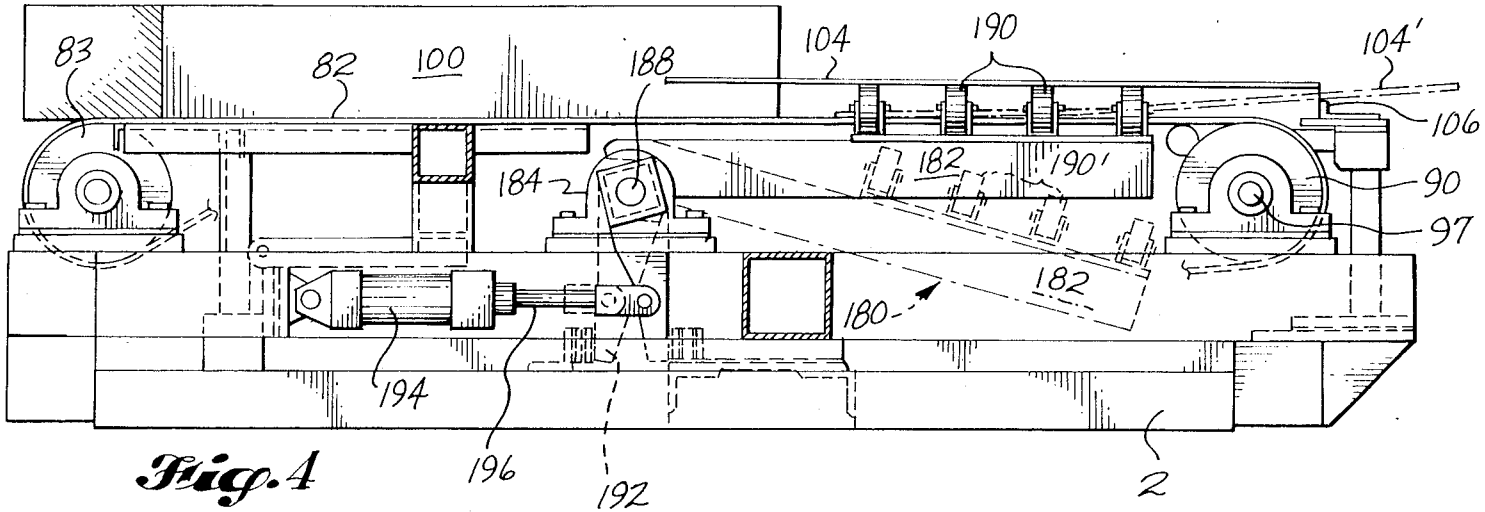
FIG. 4 is a sectional side elevation of the cross-conveyor with the superstructure removed, generally as shown in the lower portion of FIG. 3.

After the two blanks have been combined and the pressure wheels are down, stop 60 is withdrawn. At this same time, an in line roll case generally shown as 180 and best seen in FIGS. 2A, 3 and 4, is raised to lift the outboard end of the second container blank off of the cross-conveyor belts and above stop 106 so that it can more easily be conveyed by the now restarted main conveyor to the next step of the operation. The in line roll case is mounted on a subframe including a plurality of arms 182 which in turn are welded to a shaft 188 mounted in pillow blocks 184, 186. A series of small rollers 190, 190' are mounted on arms 182. Depending from the shaft is a bell crank lever arm 192 which is connected to an activating pneumatic cylinder 194 through piston rod 196.

Figure 8:
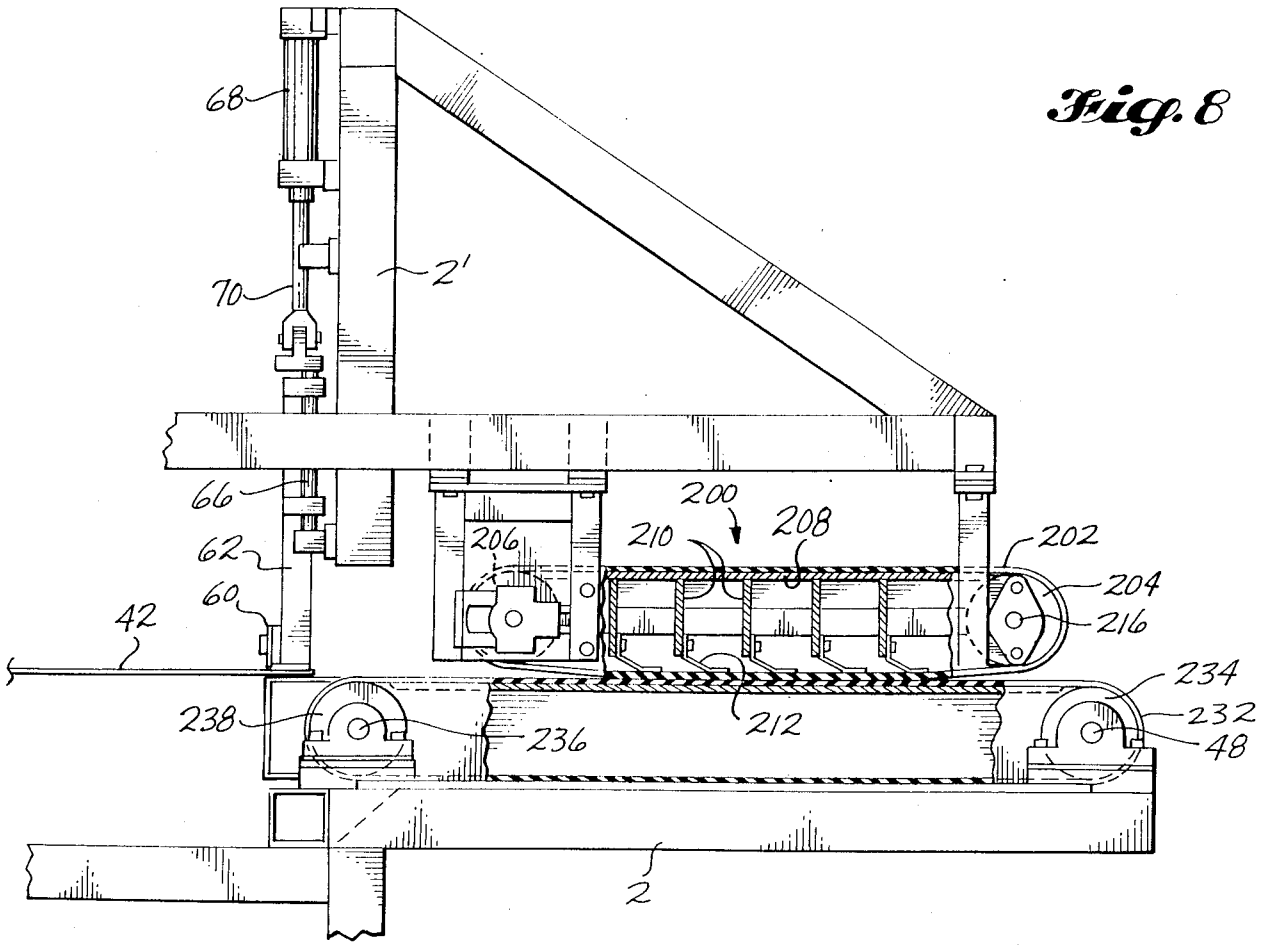
FIG. 8 is a more detailed right side elevation of the compression section at the first combining station.
Figure 9:
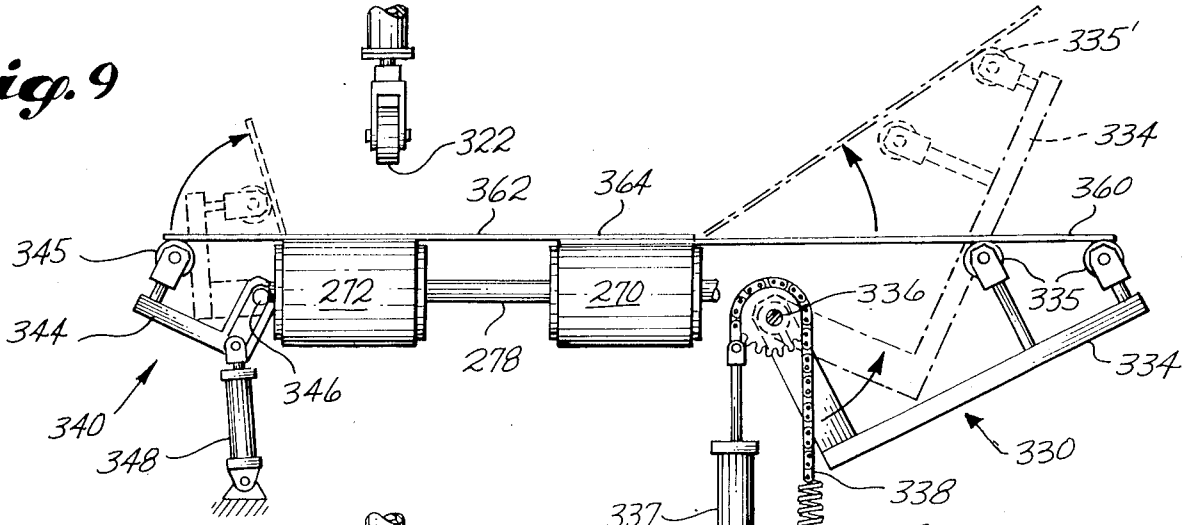
FIG. 9 is an end elevation of the folding mechanism seen at the beginning and the early stages of folding the container blank.

As the once bonded blanks advance down stream, they pass under a compression belt assembly, generally indicated at 200 and best seen in FIGS. 1A and 8. This consists of a flexible moving belt 202, mounted on a driven roller 204 and an idling roller 206. An internal framework 208 supports a series of depending fingers 210. Each of these fingers has a spring 212 mounted at the lower end for supplying a downward force on the lower run of belt 202. The compression belt is run by main conveyor drive motor 50 through drive chain 54, compression belt drive sheave 214 and drive shaft 216 (FIG. 5). An idler pulley 218 completes the drive assembly.

Figure 2B:
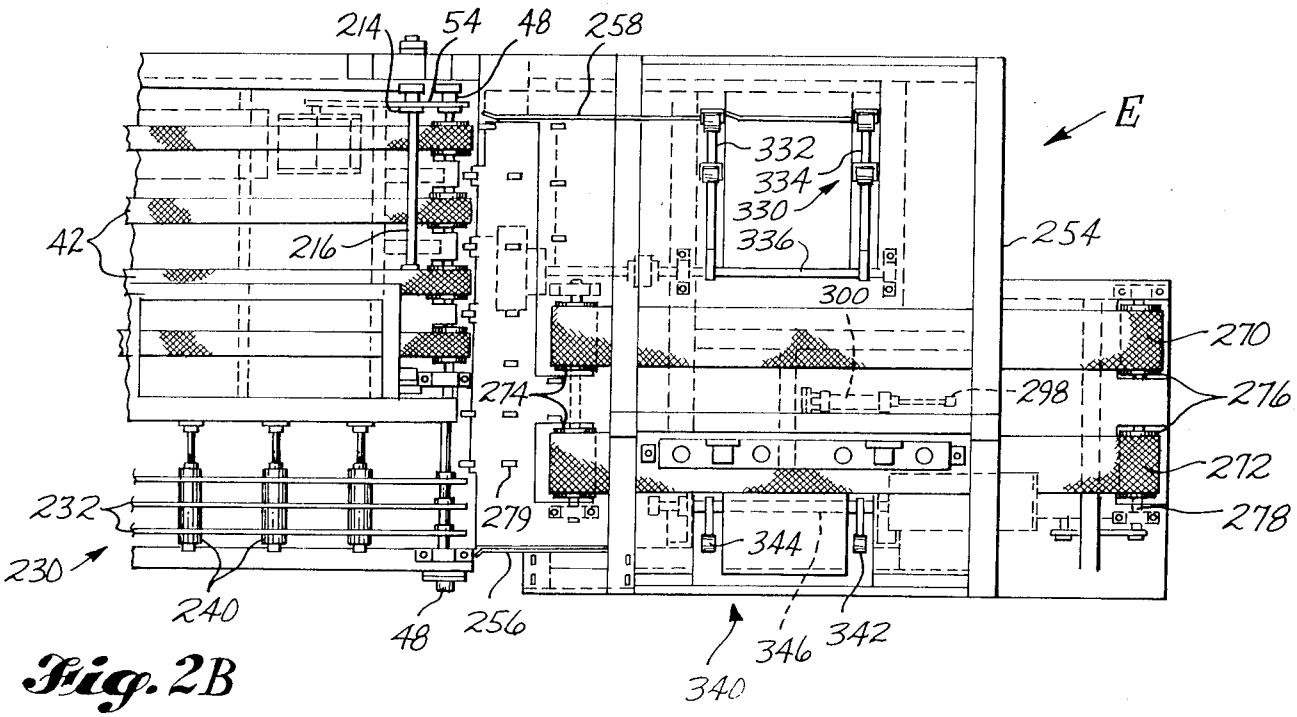
FIG. 2B is a similar view of the right portion of the machine.

As the once-bonded blanks advance through the compression belt assembly 200, the outboard end is supported on a series of auxiliary conveyor belts, generally shown at 230 on FIGS. 2B and 5, which run parallel to the main conveyor. This auxiliary conveyor consists of a number of belts 232, of which only two are numbered, which run over idler pulleys 238 and driven pulleys 234 which are connected directly to drive shaft 48 of the main conveyor. The idler pulleys are mounted on a parallel shaft 236 (FIG. 2A). A series of idler rolls 240 supports the mid-section of the auxiliary conveyor belts.

The machine described to this point is the basic machine. The two blanks being bonded together at one of their side panels can be handled in flat form. Further, they can be assembled from this point much in the same manner as a conventional shipping container. However, if desired an expanded form of the machine can be provided to complete assembly of the shipping container. Reference should now be made to FIGS. 1A, 1B, 9 and 10. As the once-bonded blanks advance off the downstream and of the main conveyor system 40, they pass by an adhesive spreader 250, 252 similar to that shown on FIG. 1A at 30, 32 and previously described. This can be located to apply adhesive to the uncombined flap of either blank while the blank is being conveyed to a second combining station. The second combining station and folder section are mounted on a frame 254 which is shown here as separate from the frame 2 of the other unit but which could be integrally combined. The blanks are precisely indexed by movable fences 256, 258. As they leave the main conveyor section, they are picked up by air permeable vacuum conveyor belts 270, 272 which overlie vacuum boxes 271, 273 (best seen in FIG. 16). These vacuum belts run on idler pulleys 274 and driven pulleys 276 mounted on shaft 278. A series of small rollers 279 mounted at the lead-in end of the folder section reduces moving friction of the blank (FIG. 2B). The vacuum belts 270, 272 are directed over a series of idler pulleys 290 which take up any slack. A drive motor and clutch brake unit 292 is coupled through a gear box 294 and chain or belt drive 296 to drive shaft 278. A third retractable stop mechanism 298 is located between the vacuum belts. This is actuated by a pneumatic cylinder 300.

Figure 10:
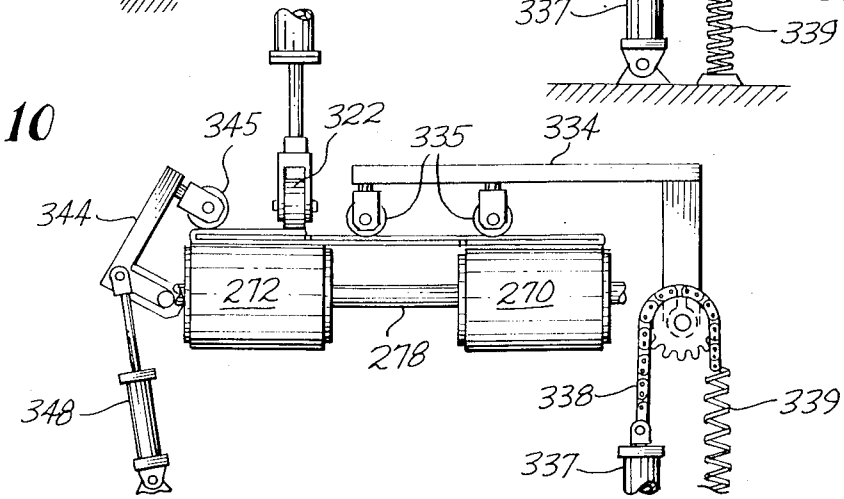
FIG. 10 is a similar view to FIG. 9 shown at the completion of a folding cycle.

When the once bonded blank hits stop 298, a sensor deactivates motor/clutch brake 292 to stop movement of the vacuum belts. At this time, the first folder mechanism is activated. This is best seen in FIGS. 1B, 2B and 10. This mechanism, generally indicated at 330, consists of two side by side folder arms 332, 334 bearing rollers 335 at their terminal end. The arms are joined in unitary fashion to a shaft 336. The folding action of the arms is actuated by means of a pneumatic cylinder 337 moving a chain 338, attached to a loading spring 339, over an appropriate chain sheave attached to shaft 336.

When the first fold is completed, the second folder mechanism, generally indicated at 340, comes into action. This is also best seen in FIGS. 1B, 2B, and 10. It consists of a pair of folder arms 342, 344 having wheels 345 to act against the container blank. The arms are mounted in unitary fashion to shaft 346 which is activated by a penumatic cylinder 348.

After the second fold is made, the second pressure roll assembly descends to bear against the now fully assembled container. The second pressure roll assembly is generally indicated at 310 and is mounted in a frame extension 254' (best seen in FIG. 1B). It comprises a subframe 312 mounted in ways 314, 316 to frame extension 254'. The subframe is activated by pneumatic cylinders 318, 320 through piston rods 322, 324. A series of pressure wheels 326 can be brought to bear against the now fully assembled containers to ensure a strong glue bond by holding the flaps tightly together as they exit the folding section of the expanded version of the machine.

While the control and timing means for either version of the present forming machine forms an integral and essential element, this element, in itself, is not considered to be novel. Given the description of either version of the machine already presented, it would be within the skill of the art of a competent machine designer to supply an adequate control and timing means. For this reason, it will not be shown or described in detail. However, the general elements and operation of a control and timing means useful on the basic machine will be given as an example. The first operation would be to activate the start switch. This will turn on the main conveyor and the first stop will come down into position. The system is now ready to operate. As the first container blank is fed through the feed rolls, adhesive is applied when a sensor, not in the main control system, senses the approaching blank. This sensor is preferably an infrared "eye" which does not contact the advancing blank but which senses reflected infrared light. When the blank hits the first stop, a second similar eye is covered. At this point in time, the main conveyr stops and the cross-feed conveyor is started. When the cross-feed blank (the second container blank) hits its fixed stop a third eye is covered. At this point, a series of operations commences. The cross-feed conveyor is turned off and the suction cup cylinder is activated into the down position. At the bottom of the suction cup stroke, a switch is activated which causes a vacuum valve to open. A 0.2 sec. delay is introduced at this time which allows the suction cups adequate time to grasp the blank. After the delay time, the suction cups and blank are lifted. At the top of the stroke a fourth eye is covered and the transfer carriage cylinders are activated. Then at the end of carriage travel, a second switch is contacted. This causes the vacuum cup cylinders to be again activated into the down position where the second blank is contacted with the adhesive-covered panel of the first blank. At the same time, the three compression rolls are moved to the down position against the stock. At the end of the downstroke limit, a third switch is contacted. This causes the vacuum to be turned off and the cups to be retracted. As the cups withdraw, the stock eye is uncovered to again start the main conveyor. Simultaneously, the first stop is retracted and the cross-feed rolls or swinging lift rolls are raised to lift the blank off of the cross-feed belts. An additional eye is located about eight inches downstream from the first stop on the main conveyor. When the stock clears this eye, the stop is relowered and the machine is then ready for the next blank to be fed.

Most conveniently, all of the sensors and control systems are tied into a programmable controller which can be readily changed or adapted as the need might arise.

A similar set of control and timing operations are employed on the folder portion of the expanded machine.

Having thus described the best mode known to the inventors of practicing their invention, it will be readily apparent to those skilled in the art that many modifications can be made. It is the intention of the inventor that these equivalent structures are to be considered limited only as described by the following claims.

What is claimed is:

1. A machine for forming a full overlap shipping container blank or like article from two similarly configured planar container blanks, each planar blank having a main panel and longitudinal side panels on each side of the main panel, which comprises:

(a) main conveyor means for conveying a first container blank to a combining station;

(b) retractable first stop means located adjacent the first conveyor means for temporarily holding the first container blank at the combining station, said combining station being located on the main conveyor upstream from the first stop means;

(c) adhesive applicator means adjacent the main conveyor for applying adhesive to one longitudinal side panel of the first blank during transport;

(d) a cross conveyor means situated laterally adjacent and normal to and essentially coplanar with the main conveyor means and in-line with the combining station for transporting a second container blank to a predetermined position adjacent the combining station;

(e) second stop means situated adjacent to the main conveyor means for temporarily retaining the second container blank adjacent to the first conveyor;

(f) translatable lifting and indexing means for moving the second blank from its position at the second stop means into register over the first blank so that one side panel of the second blank is positioned over the adhesive covered side panel of the first blank;

(g) pressure means situated over the first combining station for combining the registered side panels into a first glueline;

(h) means to convey the glued container blanks from the machine;

(i) drive means for conveyors;

(j) a frame supporting the conveyors, stop means, adhesive applicator means, lifing and indexing mean, pressure means, and drive means; and (k) control and timing means operatonally connected to the conveyors, first stop means, lifing and indexing menas, and pressure means for controlling the sequence of operational steps.

2. The machine of claim 1 in which the control and timing means includes means to stop the first conveyor means when the first blank reaches the retractable first stop means and means to stop the cross conveyor means when the second blank has reached the second stop means.

3. The machine of claim 2 in which the control and timing means includes means to retract the first stop means after the blanks have been combined and means to restart the first conveyor means to convey the glued blanks from the machine.

4. The machine of claim 1 in which the second stop is fixed in position.

5. The machine of claim 4 which further includes swinging lift rolls associated with and oriented normal to the cross conveyor means to support the glued container blanks as they are conveyed from the combining station.

6. The machine of claim 1 in which the lifting means comprises vacuum cups integral with the indexing means.

7. The machine of claim 6 in which the timing means causes the vacuum cups to translate downward to engage the second blank, then return to a raised position after said blank is engaged, whereupon the indexing means translates horizontally along the longitudinal axis of the cross conveyor means to place the second blank in position for combining with the first and, when in combining position, the vacuum cups again translate downward, release the second blank, and the indexing means and vacuum cups return to their original position.

8. The machine of claim 1 in which the pressure means comprises a set of rolls that translate downwards onto the registered side panels.

9. The machine of claim 1 which further includes additional pressure means acting on the glued blanks as they are conveyed from the machine.

10. The machine of claim 10 in which the additional pressure means comprises an elongated belt bearing on the glued side panels.

11. A machine for forming a full overlap shipping container or like article from two similarly configured planar container blanks, each planar blank having a main panel and longitudinal side panels on each side of the main panel, which comprises:

(a) main conveyor means for conveying a first container blank to a first combining station;

(b) retractable first stop means located adjacent the main conveyor means for temporarily holding the first container blank at the first combining station, said first combining station being located on the main conveyor upstream from the first stop means;

(c) first adhesive applicator means for applying adhesive to one longitudinal panel of the first blank during transit;

(d) cross conveyor means situated laterally adjacent and normal to and essentially coplanar with the main conveyor means and in-line with the first combining station for transporting a second container blank to a predetermined position adjacent the first combining station;

(e) second stop means situated adjacent ot the main conveyor means for temporarily retaining the second container blank adjacent to the first conveyor and combining station;

(f) translatable lifting and indexing means for moving the second blank from its position at the second stop means into register over the first blank so that one side panel of the second blank is positioned over the adhesive covered side panel of the first blank;

(g) first pressure means situated over the first combining station for combining the registered side panels into a first glueline;

(h) transporting means for further advancing the once bonded blanks while still in essentially planar form to a second combining and folding station;

(i) retractable third stop means located adjacent the transporting means for temporarily holding the once bonded blanks at the second combining and folding station;

(j) second adhesive applicator means adjacent the transporting means for applying adhesive to the uncombined flap of either blank while being conveyed to the second combining station;

(k) first folding means for folding the main panel having the adhesive-free flap into a flat configuration so that said panel and flap overlie the other main panel;

(l) second folding means for folding the adhesive-coated flap into a flat configuration overlying the adhesive-free flap;

(m) second pressure means for combining the now registered second flaps into a second glueline;

(n) means to convey the glued container blanks from the machine;

(o) drive means for the conveyors;

(p) a frame supporting the conveyors, stop means, adhesive applicator means, lifting and indexing means, pressure means, folding means, and drive means; and (q) control and timing means operationally connected to the conveyors, stop means, lifting and indexing means, pressure means and folding means for controlling the sequence of operational steps.

12. The machine of claim 11 in which the control and timing means includes means to stop the first conveyor means when the first blank reaches the retractable first stop means and means to stop the cross conveyor means when the second blank has reached the second stop means.

13. The machine of claim 12 in which the control and timing means includes means to retract the first stop means after the blanks have been combined and means to restart the first conveyor means to advance the glued blanks toward the second combining station.

14. The machine of claim 11 in which the second stop is fixed in position.

15. The machine of claim 14 which further includes swinging lift rolls associated with and oriented normal to the cross conveyor means to support the glued container blanks as they are conveyed from the machine.

16. The machine of claim 11 in which the lifting means comprises vacuum cups integral with the indexing means.

17. The machine of claim 16 in which the timing means causes the vacuum cups to translate downward to engage the second blank, then return to a raised position after said blank is engaged, whereupon the indexing means translates horizontally along the longitudinal axis of the cross conveyor means to place the second blank in position for combining with the first and, when in combining position, the vacuum cups again translate downward, release the second blank, and the indexing means and vacuum cups return to their original position.

18. The machine of claim 11 in which the first pressure means comprises a set of rolls that translate downwards onto the registered side panels.

19. The machine of claim 11 which further includes additional pressure means acting on the glued blanks as they are conveyed from the first combining station.

20. The machine of claim 19 in which the additional pressure means comprises an elongated belt bearing on the glued side panels.

21. The machine of claim 11 which further includes an additional independent conveyor means in-line with the main conveyor for carrying the once bonded blanks into the second combining station.

22. The machine of claim 21 in which the second pressure means comprises a set of rolls that translate downward onto the registered side panels.

* * * * *